US005845742A

United States Patent [19]

Tade et al.

[11] Patent Number: 5,845,742

[45] Date of Patent: Dec. 8, 1998

[54] CONTAINER SUPPORT BRACKET

[76] Inventors: Erin Jessica Tade; Robert Thomas Tade, both of 2912 Ave. O, Nederland, Tex. 77627

[21] Appl. No.: 604,571

[22] Filed: Feb. 21, 1996

[51] Int. Cl.[6] ..... E06C 7/14

[52] U.S. Cl. ..... 182/129; 248/211

[58] Field of Search ..... 182/129; 248/210, 248/211, 238

[56] References Cited

U.S. PATENT DOCUMENTS

| | | | |
|---|---|---|---|
| 978,550 | 12/1910 | Boyd | 248/211 |
| 1,200,936 | 10/1916 | Hall | 248/210 |
| 1,972,064 | 8/1934 | Moushon | 248/210 |
| 2,243,799 | 5/1941 | Glosier | 248/211 |
| 2,394,823 | 2/1946 | Thorson | 248/210 |
| 3,154,282 | 10/1964 | Monson | 248/211 |
| 3,809,351 | 5/1974 | Bravo | 248/210 |
| 3,979,097 | 9/1976 | Blane | 248/211 |
| 4,824,060 | 4/1989 | Korda | 248/210 |

FOREIGN PATENT DOCUMENTS

| | | | |
|---|---|---|---|
| 1343765 | 1/1974 | United Kingdom | 248/211 |

OTHER PUBLICATIONS

Popular Mechanics, Painters Ladder Hook, Jul. 1947, p. 126.

*Primary Examiner*—Alvin Chin-Shue
*Attorney, Agent, or Firm*—Baker & Botts, L.L.P.

[57] ABSTRACT

A container support bracket for use with a ladder to support a container having a wire handle is provided. The container support bracket has a container support member preferably pivotally attached to a rung engagement structure. The container support member has a second extension member, a first support member and a second support member, which in combination are preferably in the form of an inverted T-shape. For use with hollow rung ladders, the rung engagement structure has a first extension member which is adapted to be inserted into a hollow rung of the ladder. For use with flat rung ladders, the rung engagement structure is adapted to engage a flat rung of the ladder. Such structures are provided which have at least one support member which rests on the top of the engaged rung and anti-rotation member to keep the structure in place when a paint can is hung from the container support member.

4 Claims, 2 Drawing Sheets

FIG. 1
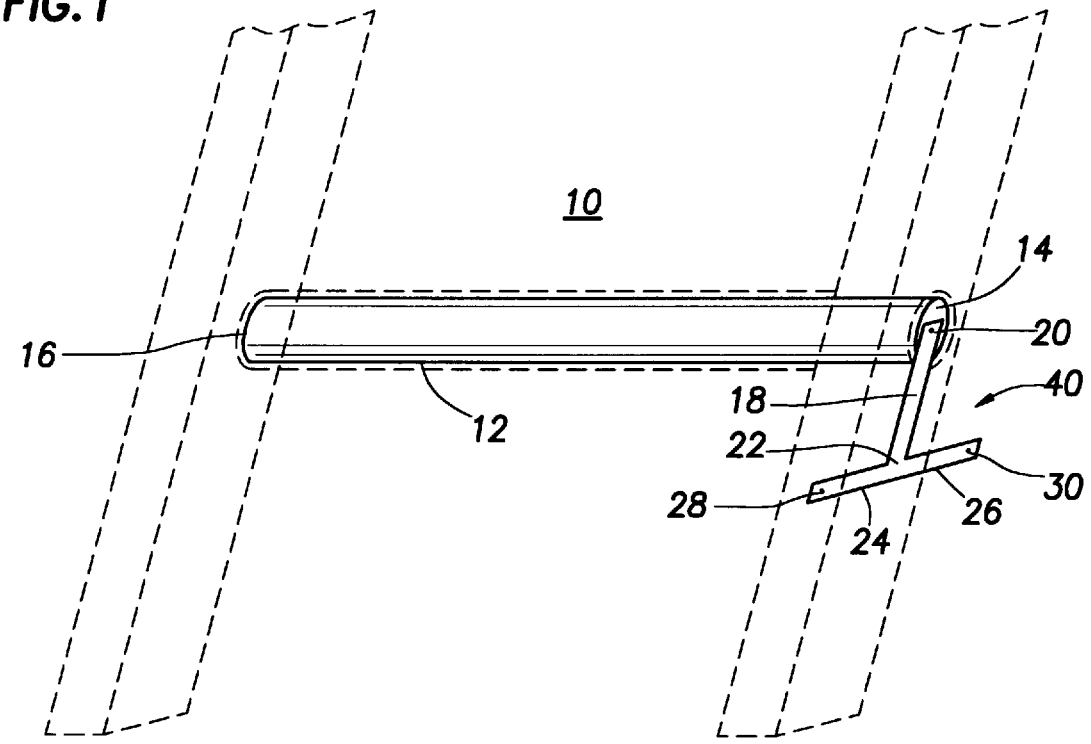
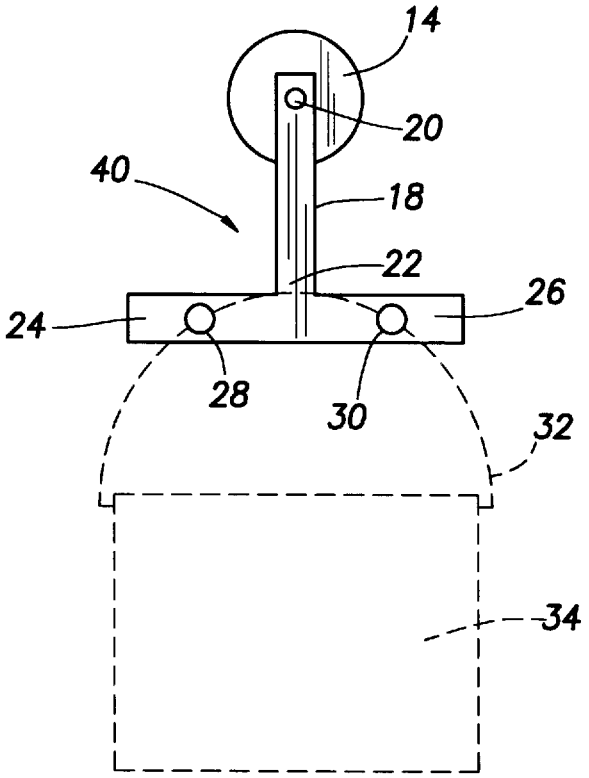
FIG. 2

CONTAINER SUPPORT BRACKET

BACKGROUND OF THE INVENTION

1. Field of the Invention

This invention relates to a device for safely hanging a paint can from a ladder while painting. The device is a bracket that may be used with flat rung ladders whereby the bracket engages the rung of the ladder in such a way as to prevent rotation in both the horizontal and vertical planes.

The invention also pertains to a container support means whereby a handle of a container—such as a paint can—is held at two points along the handle of the can by an attachment means. The attachment means may be tightened onto the handle to prevent the handle from sliding on the attachment means. This container support means may be used with the above described bracket or with any other bracket.

2. Description of the Prior Art

Amateur and professional painters alike have typically painted high surfaces while perched on a ladder with a paint can hung precariously nearby. Dropped cans, spilled paint, and tired backs have prompted countless painters to strive to produce the perfect paint can holder.

An early paint can holder is made from a single piece of stiff wire (U.S. Pat. No. 2,508,258). This device has a U-shaped saddle that wraps around one-half of the paint can, just under the rim of the can. The can with its handle removed is held in place with screws at either end of the saddle which are inserted into the holes in the side of the can which originally engaged the handle. One end of the saddle is attached to a portion adapted to fit a ladder with round rungs. This portion hooks over the rung and is supported against the leg of the ladder which prevents the holder from rotating about the rung. The other end of the saddle is attached to a second portion designed to attach to a ladder with flat rungs. This second portion functions like the first one, it hooks over the rung and is supported against the leg of the ladder which prevents the holder from rotating about the rung. Although this design allows the same holder to be used with both flat and round rung ladders, it suffers because the U-shaped saddle portion can only fit a single size can.

Another prior art paint can holder is also composed of a single piece of stiff wire (U.S. Pat. No. 3,203,658). This holder may be placed on the ladder in one of two orientations. In the front position, the wire wraps around a leg of the ladder and rotation is prevented by a portion that hooks over the rung. In the rear position, the wire wraps around the rung and rotation is prevented by a portion that hooks over the leg. In either case, the can is held by a single long hair pin loop. This design allows the can to hang on either side, in front or behind the ladder. The wire is sufficiently thin as to allow use with a telescoping ladder. However, like many holders, this one suffers because the paint can dangles freely from the hair pin loop and can slide along its handle.

A variation of this design is a single stiff wire design which combines the wire holder with a circular ring that holds the paint can coupled with a base that helps support the can (U.S. Pat. No. 3,589,939). The holder attaches to the ladder by wrapping around the leg of the ladder and hooking over the rung. A disadvantage of this holder is that the circular ring fits a narrow range of paint can sizes. Thus, different devices are required for different size cans.

The above described paint can holders share the common feature of being adapted to fit the rung and a side leg of the ladder. An alternative prior art design consists of a rod shaped member designed to fit inside the hollow rung of a ladder.

In one version, the rod is slightly bowed to provide a spring fit inside the hollow rung and the outer end of the rod is pivotally connected to a single hook from which to hang a paint can (U.K. Pat. No. 683,720). This pivotal connection to the hook allows the can to remain vertical even though the ladder may tilt somewhat when it is moved from one location to another. The main drawback with this design is that the can is allowed to swing freely from the hook in several directions and the paint can handle can slide from side to side.

A variation of this design is the straight rod with a wire spring which provides a tight fit against the inside of the rung (U.S. Pat. No. 3,223,369). The outer end of the rod is covered with a boss that has elliptical grooves designed to hold the handle of the paint can in such a way as to hold the handle to the side of the can allowing maximum access to the contents. However, unless the boss is of sufficient diameter, the groove is unlikely to contact enough of the handle to adequately control the position of the can or to prevent the handle from sliding from side to side. The inventor has diagramed the boss as the same width as the paint can, making this device somewhat cumbersome for shipment and use.

Another variation on the rod design is a simple wire rod with a hook at one end designed to engage the end of the rung opposite the end of the rung where the wire rod is inserted (U.S. Pat. No. 4,099,693). The rod also has a hook at its other end to carry the paint can. However, unlike most designs, the can is prevented from swinging by a downturned bracket portion near the hook which engages the side of the can. The downturned portion both stabilizes the can and holds the handle away from the can opening.

The rod design is also combined with a swinging box (U.S. Pat. No. 4,523,733) and with a circular ring that functions to hold a rimmed bucket (U.S. Pat. No. 5,293,957). All of these rod designs may only be used with hollow rung ladders and furthermore lack features to prevent the rod from rotating inside the rung.

SUMMARY OF THE INVENTION

Thus, there is a need for a paint can holder that is easy to use, inexpensive and not too bulky, yet holds the paint can at a convenient location near the painter, but off to the side of the ladder. The holder is preferably adaptable for use with either flat or hollow rung ladders. It should allow the can to be positioned on either side of the ladder and allow quick and easy repositioning to different heights on the ladder. It should not interfere with the painter or the use of the ladder in any way. Further, the holder should hold the can firmly and prevent rotation and swinging which might lead to spills. Finally, it should preferably allow easy access to the contents of the can. Certain ones or all of these advantages are provided in various embodiments of the present invention.

In accordance with the present invention, there is provided a container support bracket for use with a ladder to support a container having a wire handle. The container support bracket comprises a rung engagement structure having a first extension member with a first end and a second end and a container support member. The container support member comprises a second extension member having a third end and a fourth end, wherein the third end is pivotally attached to the second end; a first support member and a second support member, wherein the first and second support members extend from the fourth end; a first attachment means on the first support member for attaching the wire handle to the first support member; and a second attachment means on the second support member for attaching the wire handle to the second support member. Preferably, the second extension member and the first and second support members are in the form of an inverted T-shape.

In one embodiment, the first extension member of the rung engagement structure is adapted to be inserted into a hollow rung of the ladder.

In another embodiment, the rung engagement structure is adapted to engage a flat rung of the ladder. In such ladders, each of the flat rungs has a top, a bottom, a front edge and a back edge. In this embodiment, the rung engagement structure further comprises a third support member, a first riser member, a first anti-rotation member and a connecting member. The third support member is attached to the second end and oriented to rest upon the top of the flat rung which is engaged. The first riser member is attached to the third support member and is substantially parallel to the second extension member when the bracket is in an installed position. The connecting member connects the first riser member and the first anti-rotation member.

Preferably, the rung engagement structure further comprises a securing member, which is attached to the anti-rotation member. The combination of the securing member and the anti-rotation member substantially has a C-shape. The securing member comprises a second riser member, a fourth support member and a first hook member. The second riser attached to the anti-rotation member on one end thereof and the fourth support member on the other end thereof The first hook member is attached to the second support member. The second support member and the first support member are preferably substantially parallel to each other and rest on top of the engaged rung when in an installed position prior to hanging the paint can thereon. The first hook member engages the back edge of the engaged rung when in an installed position.

More preferably, the rung engagement structure further comprises a second anti-rotation member which extends substantially perpendicularly from the connecting member at a position intermediate of the attachment points of the first riser member and the first anti-rotation member to the connecting member.

In another embodiment of the rung engagement structure which is also adapted to engage a flat rung of a flat rung ladder, the rung engagement structure comprises a first securing member which is substantially C-shaped and has a first upper end and a first lower end, a second securing member which is also substantially C-shaped and has a second upper end and a second lower end, and a connecting member. The opening of the C-shaped first and second securing members face the same direction. The connecting member is attached to the first and second lower ends. The second end of the first extension member is attached to the second upper end. When the container support bracket is in an installed position on an engaged rung, the first and second upper ends engage the back edge of the engaged flat rung. In a preferred embodiment, the faces of the planes formed by the respective C-shaped first and second securing members are substantially parallel to each other. Preferably, the first securing member comprises a first anti-rotation member, a second riser member, a fourth support member and a first hook member, and the second securing member comprises a second hook member, a third support member, a first riser member, and a second anti-rotation member. The second riser is attached to the anti-rotation member on one end thereof and the fourth support member on the other end thereof The first hook member is attached to the second support member. The first upper end is one end of the first hook member. The first lower end is one end of the anti-rotation member. The second upper end is one end of the second hook member. The second lower end is one end of the second anti-rotation member. The other end of the second hook member is attached to the third support member. The first riser member is attached to the third support member on one end thereof and to the second anti-rotation member on the other end thereof. In an installed position prior to supporting the container, the third support member and the fourth support member rest on the top of the engaged rung and the first and second hook members engage the back edge of the engaged rung.

BRIEF DESCRIPTION OF THE DRAWINGS

FIG. 1 is a perspective view of a first embodiment of the container support bracket of the present invention.

FIG. 2 is an end perspective of the container support bracket shown in FIG. 1 supporting a paint can.

DETAILED DESCRIPTION OF THE INVENTION

Figure 3:
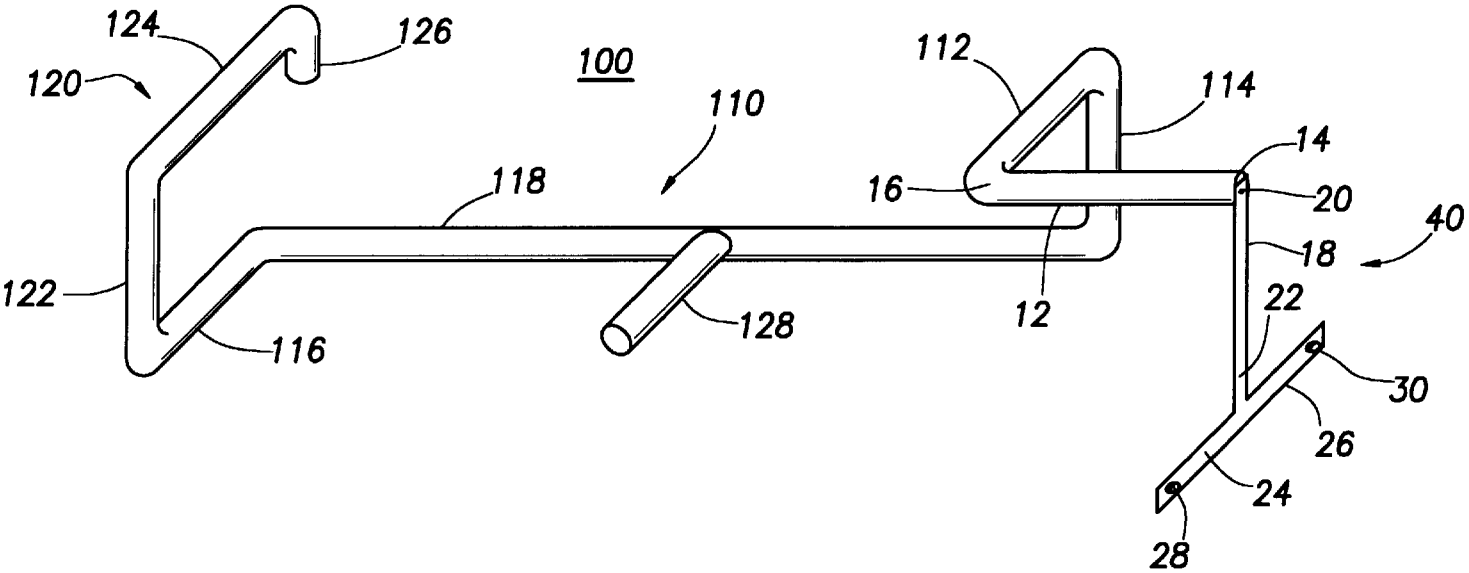
FIG. 3 is a perspective view of a second embodiment of the container support bracket of the present invention.

The present invention relates to a support bracket for a container, particularly a paint can or pail having a wire handle, for use with a ladder. Reference is made to the drawings described above with like reference numerals referring to like members in different embodiments.

Referring now to FIG. 1, there is shown a support bracket 10 having a first extension member 12 with a first end 14 and a second end 16 and a container support member 40, which includes a second extension member 18 having a third end 20 and a fourth end 22, a first support member 24 and a second support member 26. The third end 20 is pivotally attached to the first end 14 with the second extension member 18 being substantially perpendicular to the first extension member 12. The first end 14 may be a removable cap, if desired so as to use the container support member 40 of the bracket 10 with different rung engagement structure, for example, those associated with support brackets 100 and 200 in FIGS. 3 and 4. The first and second support members 24, 26 extend from the fourth end 22, in this case in opposite directions from each other and substantially perpendicular to the plane formed by the first and second extension members 12, 18. Accordingly, the second extension member 18, first support member 24 and second support member 26 form an inverted T-shape. These three members 18, 24, 26 can also form an inverted Y-shape if desired. The first support member 24 has a first attachment means 28. The second support member 26 has a second attachment means 30. The first and second attachments means 28, 30 may each be a hook or a screw. The wire handle 32 of the paint can 34 would the be hooked on the attachment means 28, 30 as shown in FIG. 2. If the attachment means 28, 30 are screws, the screws may be tightened into the respective support member 24 and 30 onto the wire handle 32. The two point attachment of the wire handle 32 keeps the paint can from sliding along the wire handle 32. The screws, if used, further secure the wire handle 32 when tightened thereon.

The support bracket 10 is used by inserting the first extension member 16 into the hollow rung of a ladder which is shown in ghost relief (that is, using dashed lines).

Referring now to FIG. 3, there is shown a support bracket 100 for use with a ladder having flat rungs with each rung having a top, a bottom, a front edge and a back edge. The support bracket 100 is like the support bracket 10 except that the first end 14 of the first extension member 12 is attached to a rung engagement structure 110 The rung engagement structure 110 has a third support member 112, a first riser member 114, a first anti-rotation member 116 and a connecting member 118. The third support member 112 is substantially perpendicularly attached to the second end 16 and oriented to rest upon the top of the rung which is engaged. The first riser member 114 is also substantially perpendicularly attached to the third support member 112 and is substantially parallel to the second extension member 18 when the bracket 100 is in an installed position. The first anti-rotation member 116 is substantially parallel to the third support member 112 and accordingly oriented to engage the bottom of the engaged rung. The first anti-rotation member 116 keeps the bracket 100 from rotating about the third support member 112 when the paint can 34 is attached to the bracket 100. The connecting member 118 connects the first riser member 114 and the first anti-rotation member 116. In this preferred embodiment, the bracket 100 further includes a securing member 120, which is attached to the anti-rotation member 116 and which in combination therewith has a C-shape. Specifically, the securing member 120 has a second riser member 122, a fourth support member 124 and a first hook member 126, with the second riser 122 attached to the anti-rotation member 116 on one end thereof and the fourth support member 124 on the other end thereof. The first hook member 126 is attached to the second support member 124. The second support member 124 and the first support member 112 are substantially parallel to each other and accordingly rest on top of the engaged rung when in an installed position. The first hook member 126 engages the back edge of the engaged rung to keep the bracket 100 in position and avoid an accidental disengagement. In this embodiment of the bracket, the bracket 100 includes a second anti-rotation member 128 which extends substantially perpendicularly from the connecting member 118 at a position intermediate of the attachment points of the first riser member 114 and the first anti-rotation member 116 to the connecting member 118. It is also noted that the connecting member 118 may be extendable to accommodate ladders of varying widths.

Figure 4:
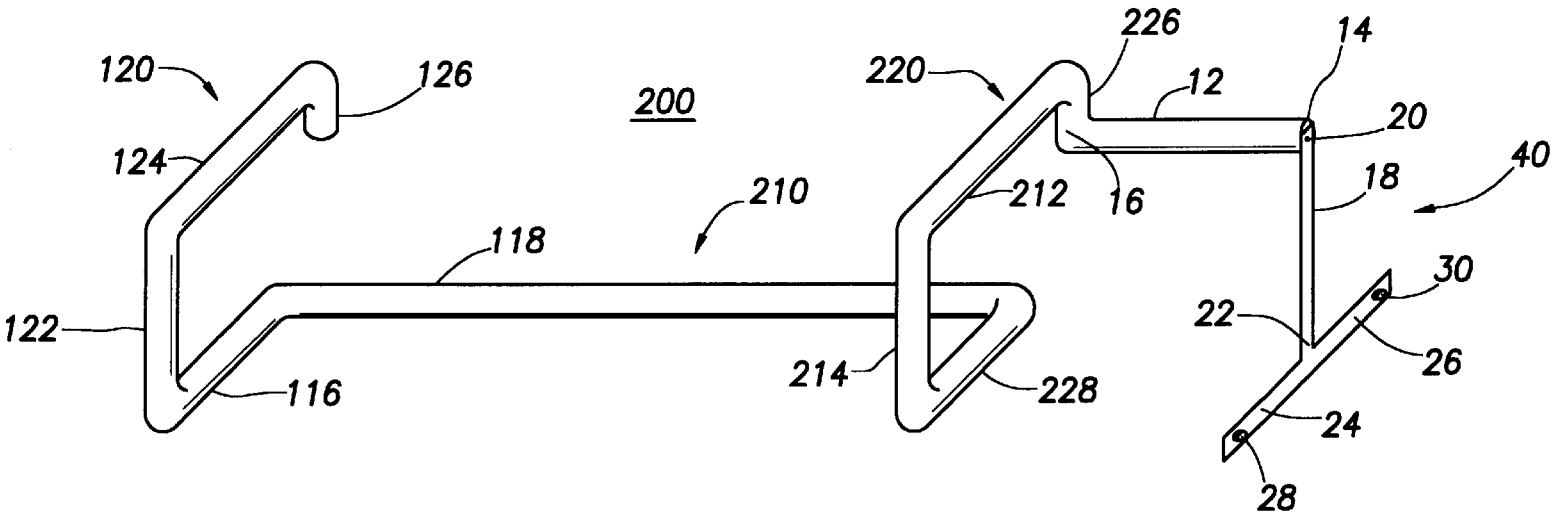
FIG. 4 is a perspective view of a third embodiment of the container support bracket of the present invention.

Referring now to FIG. 4, there is shown support bracket 200 which is another embodiment of the present invention. Support bracket 200 is like support bracket 100, except the respective rung engagement structures are somewhat different. The support bracket 200 has a second securing member 220, which like the first securing member 120, is also substantially C-shaped and in the same orientation as the first securing member 120, that is, the opening of the C-shape faces the same direction and the planes formed by the respective C-shape are substantially parallel to each other. The second securing member 220 has a second hook member 226, a third support member 212, a first riser member 214, and a second anti-rotation member 228. The second end 16 of the first extension member 12 is substantially perpendicularly attached to one end of the second hook member 226. The other end of the second hook member 226 is substantially perpendicularly attached to the third support member 212. The third support member 212 is substantially perpendicularly attached to the first riser member 214. The first riser member 214 is substantially perpendicularly attached to the second anti-rotation member 228, which in turn is attached to the connecting member 118. The remainder of the description of the support bracket 200 is like that of support bracket 100.

The third support member 212, like third support member 112, and the fourth support member 124 rest on the top of the engaged rung. The first and second anti-rotation members 116, 226 engage the bottom of the engaged rung. The first and second hook members 126, 226 engage the back edge of the engaged rung to avoid accidental disengagement of the rung engagement structure 210.

The various portions of the container support bracket may be made of any suitable material. For example, the container support member may be made of a metal T-shaped member. The rung engagement structure may be solid or hollow and may be of wood, metal or plastic. For example, PVC pipe, T's, L's and caps may be assembled into the appropriate shapes. Alternatively, the structure may be molded plastic.

What is claimed is:

1. In combination with a container support member for supporting a container from a flat rung ladder, a rung engagement structure for engaging a flat rung, the rung engagement structure comprising:

a connecting member having first and second ends, the first end proximate the container support member;

a first riser member coupled to the first end of the connecting member such that the length of the first riser member is substantially perpendicular to the length of the connecting member;

a first support member coupled to the first riser member such that the length of the first support member is substantially perpendicular to the length of the first riser member;

an extension member coupled between the first support member and the container support member such that the length of the extension member is substantially perpendicular to the length of the first support member;

a first anti-rotation member coupled to the second end of the connecting member such that the length of the first anti-rotation member is parallel to the length of the first support member;

a second riser member coupled to first the anti-rotation member;

a second support member coupled to the second riser member such that the length of the second support member is substantially parallel to the length of the first support member, the combination of the second support member, the second riser member, and the first anti-rotation member forming a C shape;

a hook member coupled to the second support member; and a second anti-rotation member extending perpendicularly from a point intermediate the length of the connecting member.

2. The rung engagement structure of claim 1, wherein the connecting member is extendable.

3. The rung engagement structure of claim 1, wherein the first and second riser members and the connecting member are integrally formed.

4. The rung engagement structure of claim 1, wherein the container support member further comprises:

a vertically extending member having a top end and a bottom end, the top end being pivotally coupled to the extension member;

first and second container arms, each of the first and second container arms extending from the bottom end of the vertically extending member; and a fastener on each of the first and second container arms for suspending a container.

* * * * *